US006385912B1

(12) United States Patent
Wessel et al.

(10) Patent No.: US 6,385,912 B1
(45) Date of Patent: May 14, 2002

(54) CONSTRUCTION SUBSTRUCTURE

(75) Inventors: Georg Wessel, Grefrath; Matthias Paul, Düsseldorf, both of (DE)

(73) Assignee: Schiess-Defries Engineering Immobilien-und Bautrager GmbH, Duisburg (DE)

( * ) Notice: Subject to any disclaimer, the term of this patent is extended or adjusted under 35 U.S.C. 154(b) by 0 days.

(21) Appl. No.: 09/554,653

(22) PCT Filed: Nov. 26, 1998

(86) PCT No.: PCT/DE98/03508

§ 371 Date: May 16, 2000

§ 102(e) Date: May 16, 2000

(87) PCT Pub. No.: WO99/32724

PCT Pub. Date: Jul. 1, 1999

(30) Foreign Application Priority Data

Dec. 18, 1997 (DE) ..... 197 56 109

(51) Int. Cl.[7] ..... E01C 13/08; E04H 3/12; E04H 3/28; A63C 19/00

(52) U.S. Cl. ..... 52/6; 52/7; 52/64

(58) Field of Search ..... 52/6, 7, 10, 64

(56) References Cited

U.S. PATENT DOCUMENTS

| | | | | | |
|---|---|---|---|---|---|
| 4,688,357 | A | * | 8/1987 | Deaton | 52/9 |
| 5,187,894 | A | * | 2/1993 | Ripley, Sr. et al. | 52/6 X |
| 5,682,711 | A | * | 11/1997 | Warczak | 52/6 |
| 5,746,028 | A | * | 5/1998 | DiBenedetto | 52/6 |
| 6,202,356 | B1 | * | 3/2001 | Hock | 52/6 |
| 6,286,264 | B1 | * | 9/2001 | Peuler | 52/6 |

FOREIGN PATENT DOCUMENTS

| | | | | |
|---|---|---|---|---|
| DE | 36 14 772 A1 | | 11/1987 | |
| EP | 0 795 646 A2 | | 9/1997 | |
| FR | 2 698 281 | | 5/1994 | |
| FR | 2700184 | * | 7/1994 | 52/64 |
| FR | 2704261 | * | 10/1994 | 52/6 |
| GB | 2263644 | * | 8/1993 | |
| JP | 5-272246 | * | 10/1993 | 52/64 |
| WO | WO 97/07306 | | 2/1997 | |

* cited by examiner

*Primary Examiner*—Laura A. Callo
(74) *Attorney, Agent, or Firm*—Herbert Dubno

(57) ABSTRACT

A substructure for a sports field of the type which can be shifted on glide pads or rollers on a track of a foundation and in which the frame supporting the sports field can be lifted by pairs of hydraulic cylinders to facilitate inspection and maintenance of the structure beneath the frame. A track bridging the inspection and maintenance space can have a wedge-shaped section covering an opening for this space and hydraulically displaceable into and out of position.

5 Claims, 6 Drawing Sheets

CONSTRUCTION SUBSTRUCTURE

CROSS REFERENCE TO RELATED APPLICATIONS

This is a national stage of PCT/DE98/03508 filed Nov. 26, 1998 and based upon German national application 197 56 109.8 of Dec. 18, 1997 under the International Convention.

FIELD OF THE INVENTION

The invention relates to a substructure for structures, particularly for sport fields in trough-shaped support frames or for stand sections which, by means of vertical support arranged underneath and equipped with rollers or sliding cushions, are horizontally movable by rolling or sliding on tracks embedded in a sub-floor.

BACKGROUND OF THE INVENTION

The scarcity and high cost of building land, as well as current maintenance costs force stadium operators to search for the possibility of using a soccer field and/or a light-athletics stadium more than once a week or once in 14 days. In order to arrange big events, such as certain concerts, stages must be erected in the stadium. During the construction and dismantling of the stage, and also partially due to the big event itself, immediate damage to the grass can not be avoided, even when the stadium grass is covered by plates or the like.

Moreover covered multi-purpose halls can be used for various sports, as well as for concerts, shows or the like by functionally restructuring their interior spaces. However as a rule the hall interior is too small for soccer, rugby or light-athletic throwing sports. But even a multipurpose hall with correspondingly large dimensions would be inappropriate for an interior requiring a durable grass surface, since in the closed halls it would lack the natural growth conditions such as sufficient sun light and watering by rain. These conditions can be only partially fulfilled by an unfolding or sliding roof. In any case the drawback of considerable damage to the grass due to the multiple use persists, so that after only a short time it will no longer suit the requirements. The substitute use of rolls of natural lawn is excluded, since the respective lawn strips or lawn squares do not have enough time to firmly bond with the substrate.

Besides, the requirements for sports stadiums and concert or show arenas are completely different. While in the case of sports stadiums the problem is to create space for as many spectators as possible around the sport field, which is rectangular, such as for soccer, or oblong/oval such as for light-athletic events, in the case of a show or a concert the spectator space behind the stage is not needed or cannot be used at all, so that otherwise usable spectator rows can go unused.

Therefore multifunctional arenas have been proposed, wherein sports and show spaces can be shifted in relation to the spectator rows. The respective sports field rests then, e.g. as described in GB 2 263 644 A, on one or more supports which on the upper side carry the grass and an underlying soil substructure, and which is slidable along slide or roller tracks in relation to a base. The same applies for such supports which carry ice-hockey fields, elastic wood floors or the like. By displacing these supports the desired play field or any other support construction can be brought to the center of the arena or removed from there.

In FR 2 441 033 A1 it has been proposed to arrange not only individual playing field sections so as to be horizontally slidable, but also to make sections of the stands shiftable. However the method described therein, which lets the respective sections "float" has proven unsuitable in practice. By contrast slide cushions made of polytetrafluoroethylene (PTFE) on steel tracks have proven themselves in practice. The required horizontal propelling force is provided by means of hydraulic cylinders.

In all cases there are problems during inspections and repair work, namely in the area of the underside of the support frame, or of the support located there, and particularly in the rollers or slide cushions, which for the horizontal displacement of the heavy load of support frames or stand sections are subject to heavy wear during use and have to be replaced. The space available underneath a support frame or a stand section is as a rule too shallow, so that underneath this construction an inspection space or passage must be provided, which makes possible inspection, as well as repair. Furthermore it must be possible to effect repair and replacement of the respective slide cushions, rollers, supports, etc.

OBJECT OF THE INVENTION

It is therefore the object of the present invention to provide an improved substructure for the purposes described, particularly with respect to inspection passages, for easy repair and if necessary replacement of the existing roll or sliding means, or other structural components located therebelow.

SUMMARY OF THE INVENTION

This object is achieved in substructure particularly for sport fields in trough-like support frames or for stand sections which are supported on and horizontally slid or rolled on tracks embedded in a sub-floor by means of vertical supports arranged underneath and provided with rollers or slide cushions according to the invention, by means of one or more raisable bridges, which can be lifted by hydraulic cylinders supported on foundations or on pile heads. Preferably on the underside of the support frames or on the upper side of the bridges, supports are provided which can consist for instance of PTFE cushions. The maximal stroke of the hydraulic cylinder transmitted to the bridge has to be bigger than the range of inherent elasticity of the rollers or slide cushions under load. Only when this condition is fulfilled will the slide cushions or rollers lift from the respective tracks and can be inspected. If according to a preferred further embodiment of the invention, underneath the bridge a passable inspection space is arranged, then the accessibility of the slide cushions or rollers (from underneath) is considerably facilitated.

As an alternative to the aforementioned solutions, it is also possible to provide additional supports against which or from which hydraulic cylinders can be vertically advanced, which are supported either on platforms or on pile heads or on a track bridge arranged between two track ends. In this variant the substructure with its additional supports is oriented through horizontal displacement so that it can be lifted by the hydraulic cylinders, so that respective rolling or sliding means required for the horizontal displacement can be relieved. Preferably under the track bridge a movable inspection space is arranged.

The accessible inspection space is the equivalent of a separation of the sub-floor from the rail or slide system. In the inspection passage the length extension of the slide tracks or rails cannot be embedded in the sub-floor, but have to be compensated for. For this purpose preferably the track of the track bridge has two mutually facing track end pieces, and the gap located between them can be closed by a horizontally movable wedge, whose wedge surfaces can be each applied under pressure substantially with a positive lock to the respective and surface of the respective track end piece in a common application plane. The two track ends of the track bridge are provided to be freely movable in the track direction, whereby the nominal distance between the two track ends can be changed. Through corresponding insertions and retractions of the wedge, the distance between the two track ends can be completely filled up. The wedge shape also insures that a compensation of the length extension of the slide or roll track is possible. In order to insure that the wedge is kept in the intended place even during the passage of a slide cushion or roller, the wedge is preferably hydraulically actuatable. In particular the wedge covers an opening to the inspection space. The aforedescribed variant creates the possibility that the support frame or the stand section can be lifted at least in the region of the inspection passage, so that through the opening covered by the wedge, after the retraction of the wedge, a slide bearing or a roller no longer under load is also accessible from the inspection space. Through such an inspection passage it is possible to inspect, repair or replace each slide cushion or roller, by successively moving the support frame of the stand section.

BRIEF DESCRIPTION OF THE DRAWING

Embodiments of the invention are represented in the drawing, in which.

SPECIFIC DESCRIPTION

As described particularly in German patent application 196 30 423.7, (U.S. Pat. No. 6,286,264) an entire lawn of a soccer field, including the substructure consisting basically of soil and pebble bottoming, is arranged on a trough-like support frame whose supports have slide cushions at the bottom. The slide tracks reach up to the area of a location outside the stadium and serve for the support of the support frame which is slidable along the slide tracks under the effect of a horizontally acting force. Basically the support frame consists of a concrete and/or steel construction, and rests on several supports arranged next to each other in a row, which with their lower ends are supported on concrete anchoring plates. The slide cushions consist of a support plate, an intermediate layer made of an elastomer with embedded sheet metal spikes with fused-on steel plates with machined grooves for PTFE insertions. The slide cushions can run along slide tracks made of wide flat steel or sheet metal with rounded edges. On the upper and lateral surfaces the slide tracks are preferably covered by a slide coating, consisting of a rust-removing agent for steel as well as a multilayer coating, consisting substantially of a binding agent, particularly an amino addition compound hardening epoxy resin, and pigments of iron oxide and/or aluminum oxide, a thixotropic agent, such as aluminum silicate and solvents, such as xylene, butanol and/or naphtha. The multilayer coating on the steel rust-removing agent has a thickness of 300 to 500 $\mu$m.

In order to enhance the slidability, optionally lubricants can be used, for which purpose oil distributor strips can be optionally used, through which at intervals electrically controlled amounts of oil reach the felt strips which apply a thin lubricant film to the slide tracks.

Figure 2:
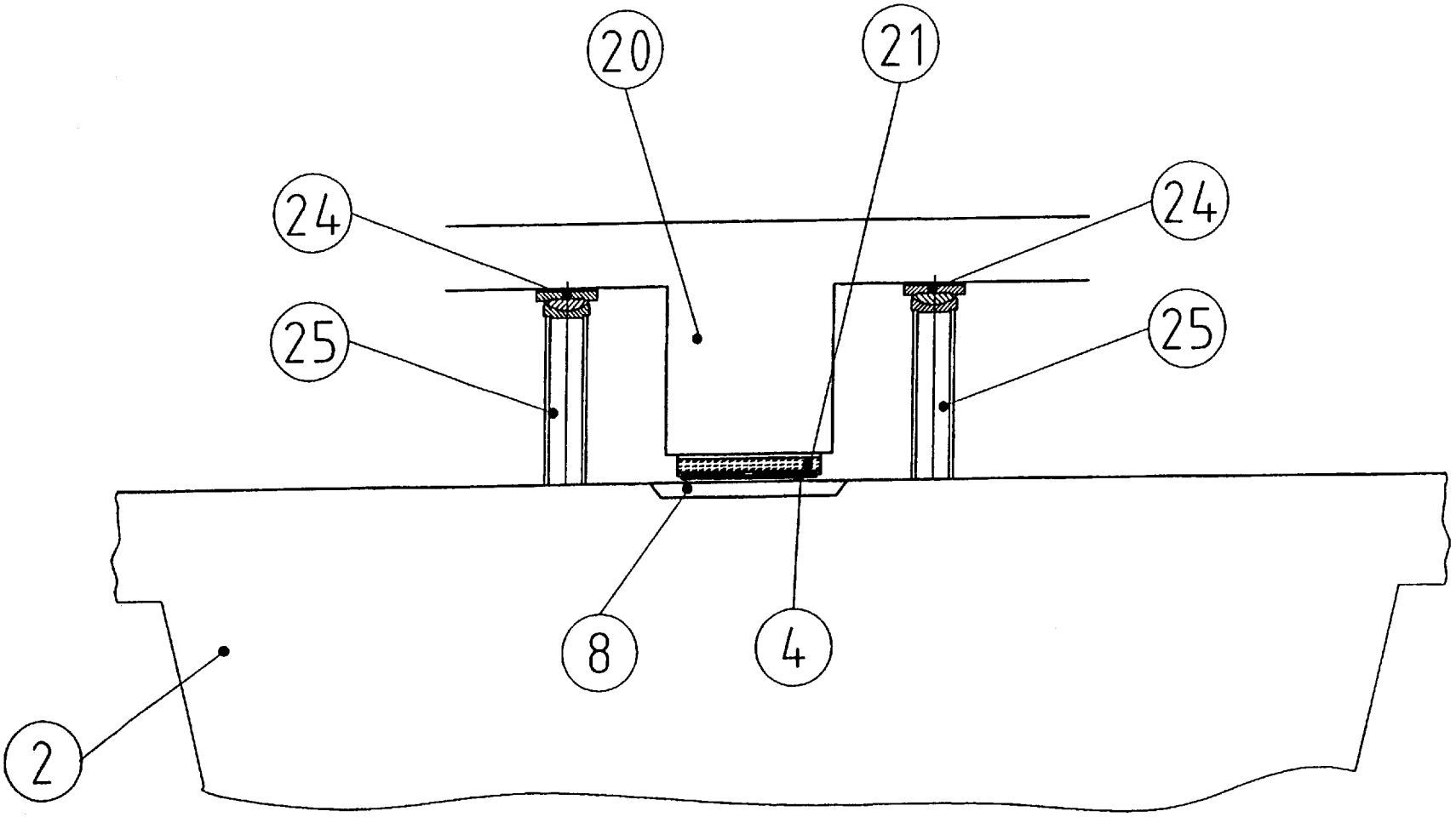
FIG. 2 is a diagrammatic sectional view of a support frame, which is lifted by means of a hydraulic cylinder to relieve a slide foot of load.

A vertical support 20 with a slide foot 21 as well as a slide cushion 4 can be seen from FIG. 2. During the horizontal displacement of the support frame, this slide cushion 4 rides on the slide track 8, several of the latter being provided in parallel next to each other.

Figure 1A:
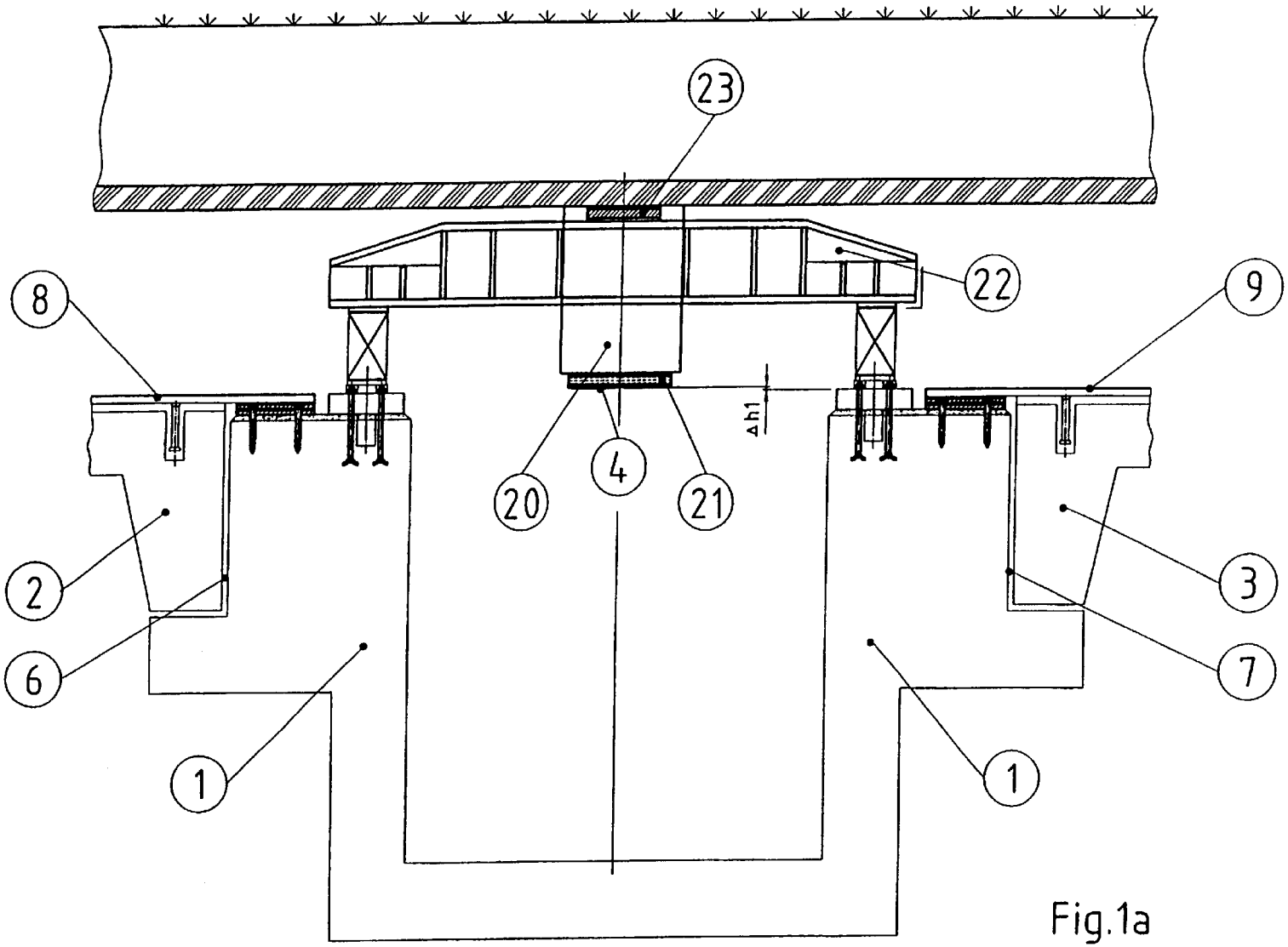
FIGS. 1*a* and 1*b* are diagrammatic sectional views of a raisable bridge with an additional support.
Figure 1B:
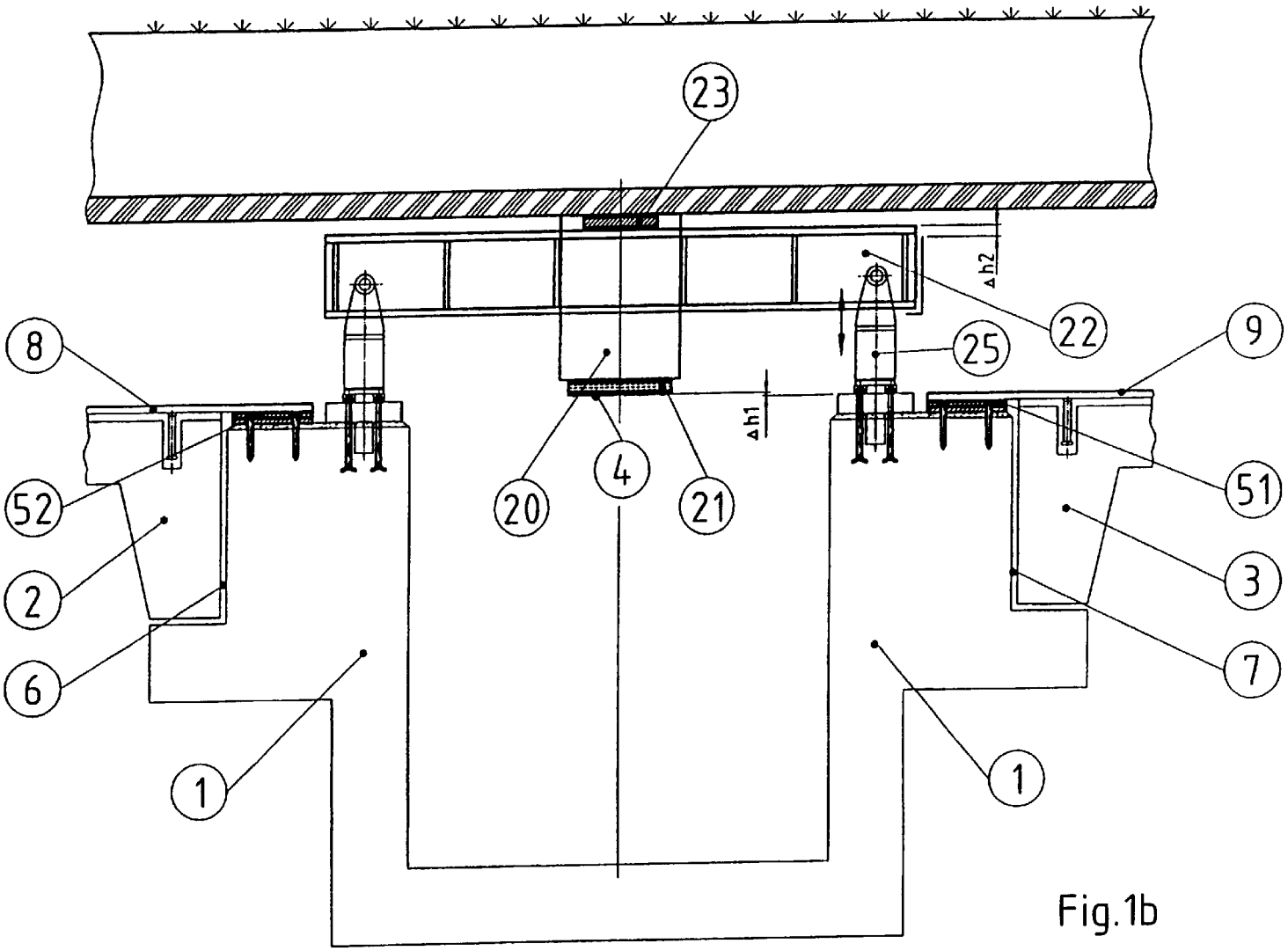

In order to lift the support frame for inspection and repair purposes, which is necessary for relieving the slide foot 21 of load, two embodiments are shown in FIGS. 1*a* and 1*b* and FIG. 2. The first embodiment consists in that, besides the vertical supports (pedestals) 20, underneath a support frame or a stand section one or more bridges 22 with supports 23 are arranged, which by means of the respective hydraulic cylinders 25 can be lifted so that the slide cushions 4 which are in the vicinity of the bridge 22 can be lifted from the tracks 8. As soon as the slide shoes reach or are stopped at the inspection space underneath the bridge 22, the hydraulic cylinders 25 are advanced and take over the load (instead of the slide foot 21) over the supports 23 designed as auxiliary slide shoes. Alternately it is possible according to the illustration in FIG. 2, to provide additional supports 24 underneath the support frames against which hydraulic cylinders 25, supported on a foundation 2 in which the slide track 8 is also embedded, can act vertically. Of course it is also possible to have constructions wherein the hydraulic cylinders 25 are rigidly connected to the underside of the support frames and that the foundation or correspondingly arranged pile heads serve as buttresses, upon which the hydraulic force acts. Corresponding to the illustration in FIG. 2 due to the advance stroke of the hydraulic cylinder the slide foot is relieved of load, so that the slide cushion 4, optionally also the slide foot 21, can be repaired or completely replaced.

Figure 3:
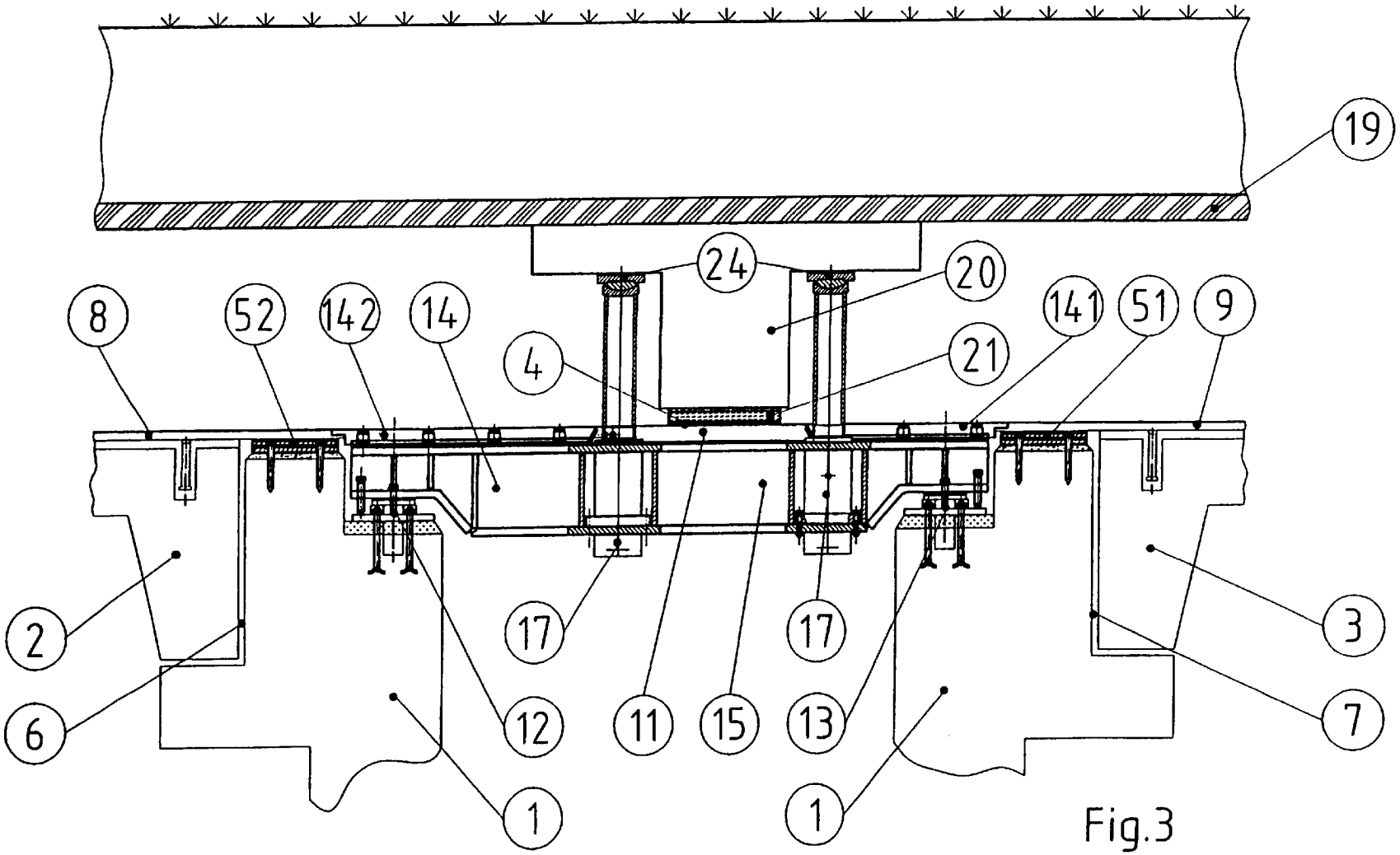
FIG. 3 is a sectional view of a support frame over an inspection bridge in lifted state.
Figure 4:
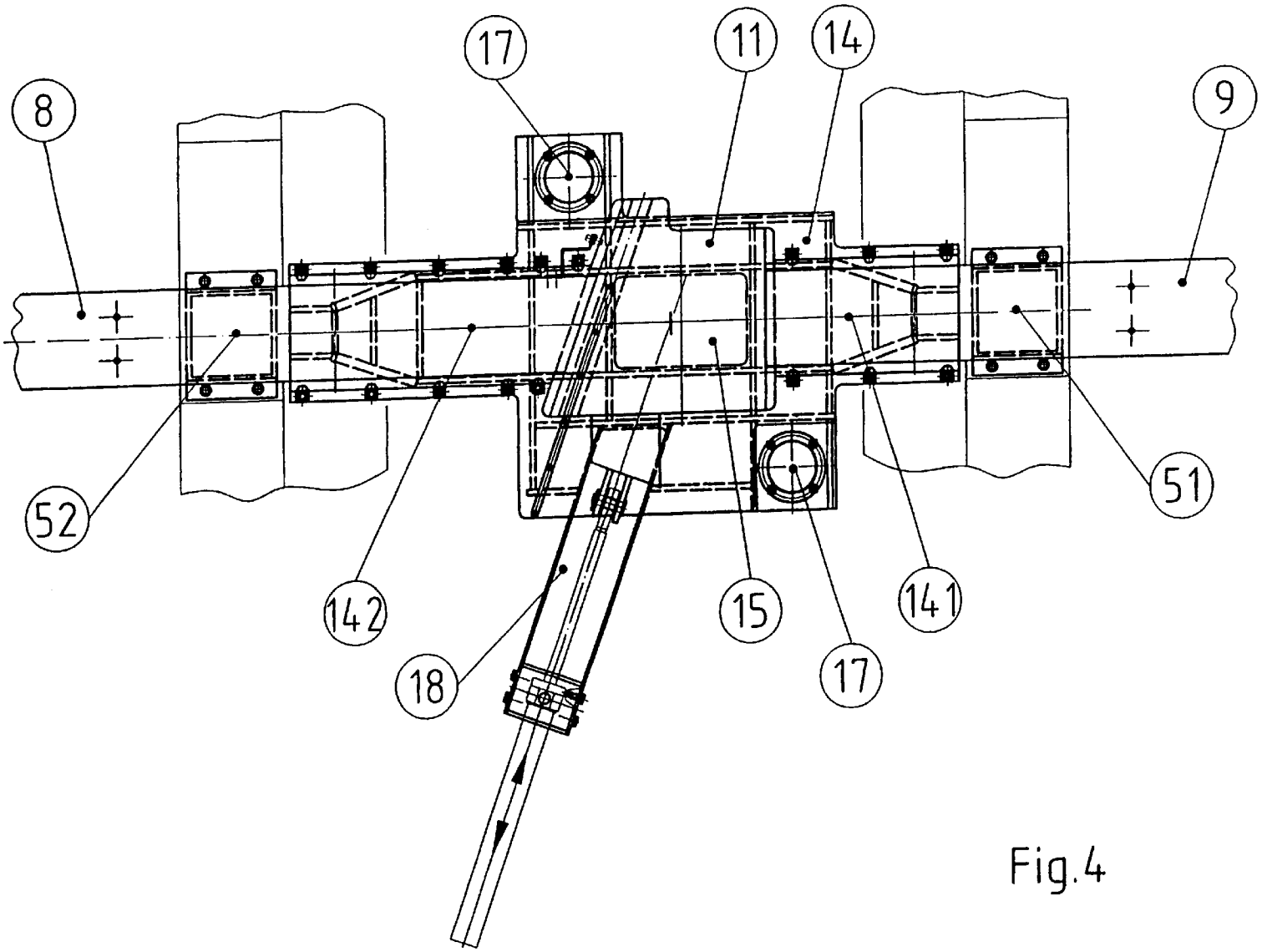
FIG. 4 is a top view of the arrangement according to FIG. 3
Figure 5:
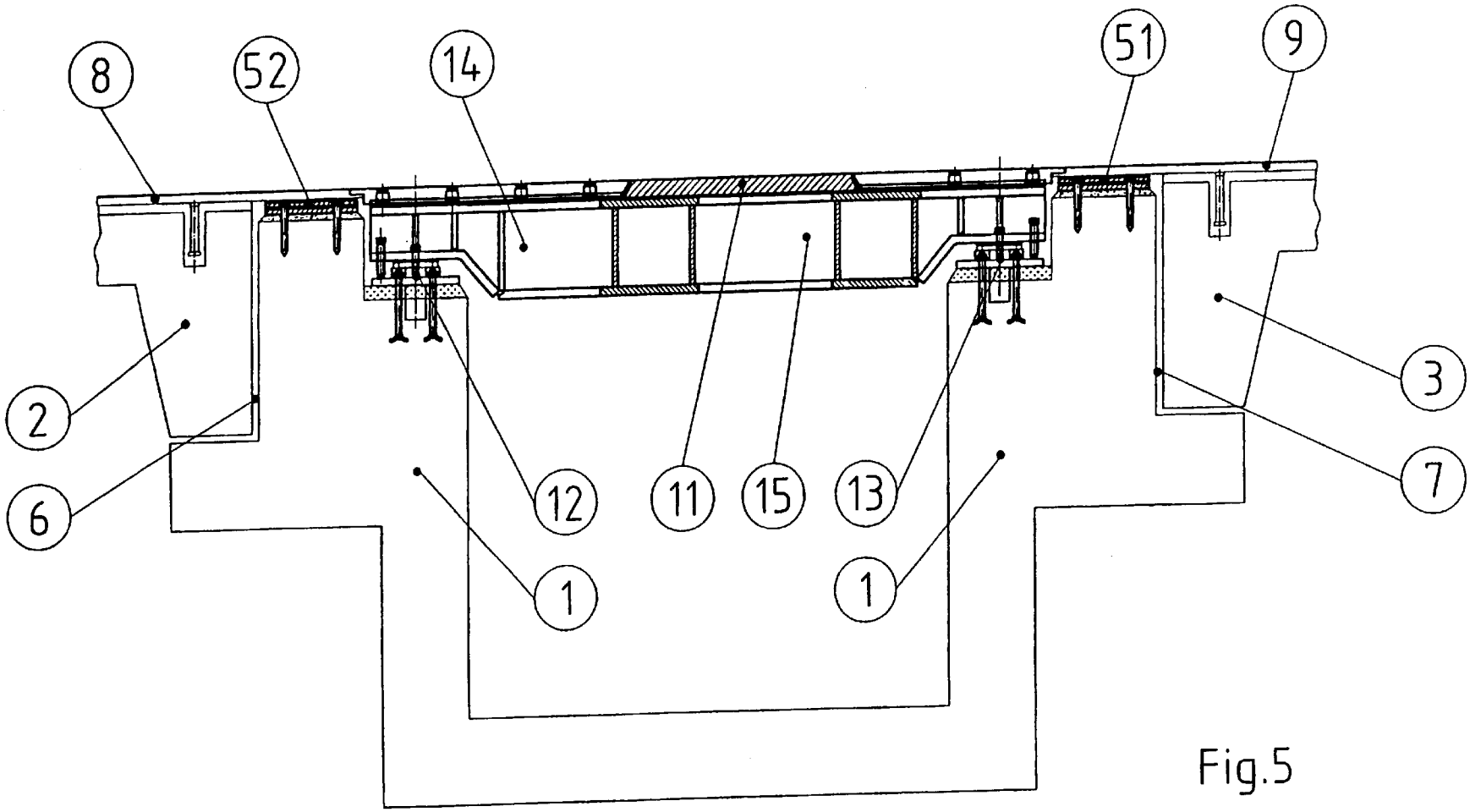
FIG. 5 is a schematic view of an inspection passage with an inspection bridge.

A preferred embodiment is shown in FIG. 3. In this illustration a complete support frame 19 with the playing field lawn is shown. On its underside this support frame has several vertical supports 20, at whose free end a slide foot with a slide cushion is arranged. These slide cushions or the totality of slide cushions are horizontally moved along slide tracks 8 and 9, in order to slide the support frames with the stadium lawn in and out of the stadium interior. The slide tracks are embedded in a concrete sub-floor 2 or 3, which is interrupted in the area of the inspection passage, whose concrete walls are shown at 1 in the drawing. The inspection passage is bridged by a track bridge 14, which consists of a steel girder subject to bending and whose ends rest on the already mentioned foundation 1 of the inspection passage. The track bridge 14 is supported on its underside by slide bearings 12 and 13, which consist substantially of a PTFE plate and an austenitic steel plate. For the concrete sub-floor 2 and 3 also slide bearings 51 and 52 are provided, of the same type as described before in the example of bearings 12 and 13. Additionally between tracks 8 and 9 expansion joints 6 and 7 can be provided, which make possible a length compensation. In the present case the bridge 14 is at the same time a buttress for the hydraulic cylinder 17, whose piston can be moved against the bearing 24. At a corresponding stroke of the hydraulic cylinder 17, the support frame 19 is lifted, whereby the slide foot 21, respectively the slide cushion 4 is relieved of load. In the present case the bearing 24 is not arranged on the support frame as an additional bearing, but as a bearing which has been widened to serve as the bearing for the concrete support 20. The bridge 14 has an opening 15, through which the slide foot 21 located above the opening is accessible for repair and inspection. This opening is closed during the sliding motion of the support frame 19 by a wedge 11, whose action and construction are shown in detail in FIG. 4. The track bridge 14 has two track end pieces 141, 142 arranged at a distance from each other, whose at least one frontal surface runs at an inclination angle to the longitudinal axis of the track 8, 9, respectively 14. The corresponding frontal surface of the wedge 11 horizontally displaceable by a hydraulic cylinder has the same inclination. Depending on the position of wedge 11, the inspection opening 15 is closed or opened. When a slide foot 21 along the bridge 14 passes over for displacing the support frame 19, the hydraulic cylinder 18 closes the opening 15 and this way insuring a closed bridge track 14. Possible length changes of the bridge 14 can therefore be compensated via the slide bearings 12 and 13 by using the expansion joints 6 and 7. The hydraulic cylinder 18 presses the wedge 11 in a positive locking against the frontal surface of the track ends 141, 142, which yield until possibly existing gaps of the bridge 14 to the adjacent slide tracks 2 and 3 are closed. For inspection and repair purposes, the slide foot 21 is pushed over the opening 15 when the wedge is extended, which can optionally be monitored through optic, electric or electromagnetic position sensors. Afterwards the pistons of the hydraulic cylinders 17 are advanced, whereby the support frame 19 together with the supports 20 are lifted. After the slide cushion 4 located on the underside of the slide foot 21 has lifted off the wedge 11, the hydraulic cylinder 18 is retracted, until the wedge 11 clears the inspection opening 15, through which the foot 21 becomes then accessible from the inspection passage.

Naturally the wedge 11 can also be combined with the lifting variants of FIGS. 1 and 2.

Independently thereof, as an option it is also additionally possible to design the slide bearings 12 and 13 as height-adjustable bearings, in order to be able to set the bridge ends at the level of the slide tracks 8 and 9. If the lifting stroke which can be achieved by means of the lifting device (hydraulic cylinder 25) is big enough, in certain cases the inspection passage can be completely eliminated.

The same approach as in the case of the aforedescribed support frames is taken regarding stand sections with corresponding substructures.

What is claimed is:

1. A movable sports field structure comprising:

a trough-shaped support frame receiving a sports field and having a plurality of support pedestals;

a foundation formed with horizontal tracks on which said supports pedestals ride;

a bridge disposed below said support frame in a region of one of said pedestals and having a pair of hydraulic cylinders braced against said foundation at opposite ends of said bridge and actuatable to lift said support frame and provide an inspection and maintenance space below said support frame; and a bearing enabling horizontal shifting of said support frame and said bridge and interposed between a location on said bridge between said hydraulic cylinders and said support frame.

2. A movable sports field structure comprising:

a trough-shaped support frame receiving a sports field and having a plurality of support pedestals;

a foundation formed with horizontal tracks on which said supports pedestals ride, and with inspection and maintenance spaces;

a track bridge on said foundation supporting said track and spanning one of said spaces;

a pair of hydraulic cylinders on opposite ends of said bridge and actuatable to lift said support frame at said inspection and maintenance space; and respective bearings between each of said hydraulic cylinders and an underside of said support frame.

3. The movable sports field structure defined in claim 2 wherein the track of said track bridge has two track end pieces arranged at a distance from one another and forming a gap between them, and a horizontally slidable wedge closing said gap, said wedge having a wedge surface forming a positive lock against end surfaces of said track end pieces in a common plane.

4. The movable sports field structure defined in claim 3 wherein the wedge covers an opening to said space.

5. The movable sports field structure defined in claim 4, further comprising a hydraulic actuator for said wedge.

* * * * *